United States Patent [19]

Freissmuth et al.

[11] 4,430,118

[45] Feb. 7, 1984

[54] DESULFURIZATION AGENT

[75] Inventors: Alfred Freissmuth, Trostberg; Werner Gmöhling, Hufschlag; Walter Meichsner, Krefeld, all of Fed. Rep. of Germany

[73] Assignee: SKW Trostberg Aktiengesellschaft, Trostberg, Fed. Rep. of Germany

[21] Appl. No.: 427,110

[22] Filed: Sep. 29, 1982

Related U.S. Application Data

[63] Continuation of Ser. No. 250,361, Apr. 2, 1981.

[30] Foreign Application Priority Data

Jun. 18, 1980 [DE] Fed. Rep. of Germany ..... 3022752

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS 4,340,422 7/1982 Takahashi ..... 75/53

*Primary Examiner*—Peter D. Rosenberg

*Attorney, Agent, or Firm*—Felfe & Lynch

[57] ABSTRACT

The present invention provides a desulphurizing agent, especially for iron melts, based upon calcium carbide and diamide lime, wherein it contains a diamide lime which has been post-treated by flotation or air sifting. The diamide lime used preferably contains 18 to 40% of free carbon.

16 Claims, No Drawings

DESULFURIZATION AGENT

This application is a continuation of Ser. No. 250,361, 4-2-81.

This invention relates to a desulfurization agent, especially for molten crude iron.

Desulfurizing agents for the iron and steel industry based upon calcium carbide and diamide lime have been known for some years (see Federal Republic of Germany Patent Specification No. 1,758,250) and attempts have also been made to improve the effectiveness of these agents by variation of the calcium carbide/diamide lime ratios (see Federal Republic of Germany Patent Specification No. 2,500,497) and by means of additives (see Federal Republic of Germany Patent Specification No. 2,741,588).

However, in spite of all of the improvements with regard to the effectiveness of these desulfurizing agents, unsatisfactory charges were still obtained, i.e. crude iron melts which, in spite of a uniform composition of the desulfurizing agent mixture and of unchanged blowing in conditions, still had much too high a final sulphur content after the treatment.

We have observed that, with the previously known technical devices, the previously known desulfurizing mixtures are not always introduced into the crude iron melts with satisfactory uniformity. In the case of intermittent conveying of the desulfurizing agent, the molten iron is brought into thrust-like contact with the desulfurizing agent. Consequently, certain parts of the melt come into contact with excess desulfurizing agent so that it accumulates in the slag, without having exerted its desired effect. For the success of the desulfurizing treatment, it is of decisive importance that the crude iron melt is brought into uniform contact with the desulfurizing agent during the whole of the period of treatment. This problem cannot be solved by means of devices alone but also requires, in particular, a good and uniform flowability of the desulfurizing agent. Furthermore, attempts have also been made to improve the economy in the case of using the desulfurizing agent, i.e. to reduce the amount used while obtaining equally good results.

Consequently, it is an object of the present invention to provide a desulfurizing agent based on calcium carbide and diamide lime with which the above-mentioned disadvantages are overcome and an improved economy can be achieved.

Thus, according to the present invention, there is provided a desulfurizing agent based upon calcium carbide and diamide lime, wherein it contains a diamide lime which has been post-treated by flotation or air sifting.

Diamide lime is a mixture consisting essentially of calcium carbonate and carbon. Such mixtures are obtained, for example, in the production of dicyandiamide products, in the course of which aqueous suspensions of calcium cyanamide are treated with carbon dioxide and then contain about 70 to 85% of calcium carbonate and about 8 to 12% of carbon, in addition to impurities, especially iron oxide, aluminium oxide and silicon dioxide. The precipitated diamide lime is subsequently subjected either to a flotation or first dried and then subjected to air sifting. The flotation and the air sifting can thereby be carried out in known manner and with apparatus conventional for this purpose (see, for example, Ullman's Encyklopädie der Technischen Chemie, pub. Verlag Chemie, Weinheim, 4th edn., Vol. 2, pp. 110–142 and 57–69).

Depending upon the nature and period of the post-treatment, the post-treated diamide lime contains about 17 to 36% of carbon dioxide, corresponding to 38 to 82% of calcium carbonate, 18 to 55% free carbon and about 5 to 10% of residual impurities, such as calcium oxide, calcium hydroxide, iron oxide, aluminium oxide and silicon dioxide. However, a post-treated diamide lime can also be mixed with an untreated diamide lime, for example, in a weight ratio of 50/50, and this "blend" used for the production of the mixture according to the present invention. It is preferred to use a diamide lime containing 18 to 40% and especially 25 to 30% of free carbon. Such a diamide lime has, for example, the following analytic values: 25 to 30% of free carbon, 28 to 30% of carbon dioxide, corresponding to 64 to 68% of calcium carbonate, as well as 5 to 10% of calcium oxide, calcium hydroxide and impurities, such as iron oxide, aluminium oxide and silicon dioxide.

By means of the post-treatment, the proportion of carbon, the calcium carbonate particles adhering to the carbon and the proportion of very fine diamide lime are especially enriched. Whereas the untreated diamide lime has an average particle size of about 35 μm., 10% being > about 75 μm. and 10% being < about 10 μm., these data are, in the case of the post-treated diamide lime, displaced towards substantially smaller particle sizes: the average particle size of a post-treated diamide lime containing about 40% carbon is only 5 μm., 10% being over about 15 μm. and 10% being below about 2 μm. These values can be displaced upwardly or downwardly, depending upon the intensity of the post-treatment.

The desulfurizing mixtures according to the present invention are produced by grinding together calcium carbide and dried, post-treated diamide lime in a mill, for example in a tube mill.

The mixture according to the present invention, produced by grinding calcium carbide with post-treated diamide lime, also differs substantially in its fineness from the desulfurizing agent produced with untreated diamide lime: the average particle diameter of a finished ground mixture of 60% calcium carbide and 40% post-treated diamide lime is about 20 to 35 μm., whereas, in the case of a mixture produced with untreated diamide lime, it is about 45 to 50 μm. In the case of the mixture according to the present invention, 10% of the particles are greater than about 70 μm. and 10% smaller than about 3 μm. In the case of the previously known desulfurizing agents of calcium carbide and untreated diamide lime, 80% of the particles lie between about 100 and about 5 μm. (10% > 100 μm. and 10% < 5 μm.).

For the production of a mixture which is optimal with regard to flowability and desulfurizing action, the milling procedure and especially the period of milling is, of course, of great importance. Normally, the minimum period of milling is about 5 minutes and the period necessary for achieving optimum results is usually from 10 to 30 minutes.

The mixture according to the present invention can also contain further conventional additives, for example, finely-divided silicon dioxide for the further improvement of the flowability, as well as additions of carbon, for example in the form of bituminous coal, hard coal or steam coal, anthracite or, especially, graphite.

Surprisingly, we have now found that the mixtures according to the present invention are substantially more effective than the mixtures produced with untreated diamide lime (in the case of the same amount of carbon dioxide present in the form of calcium carbonate) and, thanks to the uniformly good flowability, give results of good reproducibility.

Agents of the following composition have proved to be especially useful for the treatment of crude iron melts:

(a) when treatment is carried out in a torpedo ladle: 30 to 70% by weight of calcium carbide, the remainder being diamide lime;

(b) when treatment is carried out in an open ladle: 70 to 90% by weight of calcium carbide, the remainder being diamide lime.

Consequently, the present invention is also concerned with the use of the agent according to the present invention for desulfurizing iron melts, for example crude iron, cast iron and steel melts.

The mixture according to the present invention contains more carbon from the diamide lime and, in the case of the same amount of carbon dioxide in the form of calcium carbonate, less calcium carbide than the corresponding mixture produced with untreated diamide lime. Therefore, it is surprising that 1 kg. of the desulfurizing mixture according to the present invention, in spite of its reduced content of calcium carbide, desulfurizes better than 1 kg. of a mixture of calcium carbide and untreated diamide lime.

However, the substantially better action does not depend solely upon the higher content of carbon in the mixture (see Federal Republic of Germany Patent Specification No. 2,741,588). Experiments with comparative mixtures of calcium carbide and untreated diamide lime with additions of carbon in the form of graphite, petroleum coke or steam coal have, surprisingly, shown that the improved action of the post-treated diamide lime on the desulfurizing mixture is better than that of the other additives. These findings are explained in the following Example, which is given for the purpose of illustrating the present invention:-

EXAMPLE

The following mixtures were prepared:

1. 55% calcium carbide, 40% untreated diamide lime and 5% dry steam coal.
2. 55% calcium carbide, 40% untreated diamide lime and 5% calcined petroleum coke.
3. 55% calcium carbide, 40% untreated diamide lime and 5% graphite.
4. 55% calcium carbide and 45% post-treated diamide lime.

Each of these mixtures was used for a period of 2 to 4 weeks in a desulfurizing plant and their desulfurizing actions compared. The desulfurizing mixture was loosened with dry air in a powdered material distributor and, with about 4 to 10 Nl. of air per kg. of desulfurizing agent, blown through an immersed lance into a torpedo ladle filled with about 150 tonnes of molten crude iron, the initial sulphur content of which was about 0.050%.

The post-treated diamide lime used in mixture 4 had the following analytical values: 25% free carbon, 30% carbon dioxide, corresponding to 68% calcium carbonate, and 7% calcium oxide, calcium hydroxide and impurities, such as iron oxide, aluminium oxide and silicon dioxide. Its average particle size was 15 μm., 10% > 35 m. and 10% < 5 μm.

The comparison was carried out in such a manner that the amount of desulfurizing agent necessary for the treatment was, in each case, calculated according to the same formula as is employed for the conventional desulfurizing agent. Thus, in all experimental series, the same amounts of desulfurizing agent were used and thereafter the result of the desulfurizing treatment assigned to the effectiveness of the tested agent. It was thus found that mixture 4 according to the present invention was clearly superior to all the other mixtures: with mixtures 1, 2 and 3, final sulphur contents of from 0.015 to 0.013% were achieved, whereas with mixture 4 according to the present invention, the final sulphur content was 0.011%.

It will be understood that the specification and examples are illustrative, but not limitative of the present invention and that other embodiments within the spirit and scope of the invention will suggest themselves to those skilled in the art.

What is claimed is:

1. An improved desulfurization agent comprising calcium carbide and diamide lime, wherein the improvement comprising said diamide lime having been treated by flotation or air sifting.

2. Agent as claimed in claim 1 containing only diamide lime which has been treated.

3. Agent as claimed in claim 1 further comprising untreated diamide lime.

4. Agent as claimed in claim 1 wherein the diamide lime contains 18 to 40% of free carbon.

5. Agent as claimed in claim 4 wherein the diamide lime contains 25 to 30% of free carbon.

6. Agent as claimed in claim 1 for the treatment of crude iron in torpedo ladles containing 30 to 70% by weight of calcium carbide and the remainder diamide lime.

7. Agent as claimed in claim 1 for the treatment of crude iron in open ladles containing 70 to 90% by weight of calcium carbide and the remainder diamide lime.

8. Agent as claimed in claim 1 additionally containing finely divided silicon dioxide and carbon in the form of hard coal, steam coal, anthracite or graphite.

9. Method of desulfurizing molten iron, which method comprises blowing an agent as claimed in claim 1 into molten iron.

10. Method as claimed in claim 9 wherein said agent contains only treated diamide lime.

11. Method as claimed in claim 9 wherein said agent further contains untreated diamide lime.

12. Method as claimed in claim 11 wherein said treated diamide lime contains 18 to 40% of free carbon.

13. Method as claimed in claim 11 wherein said treated diamide lime contains 25 to 30% of free carbon.

14. Method as claimed in claim 9 for the treatment of crude iron in torpedo ladles wherein said agent contains 30 to 70% by weight of calcium carbide and the remainder is diamide lime.

15. Method as claimed in claim 9 for the treatment of crude iron in open ladles wherein said agent contains 70 to 90% by weight of calcium carbide and the remainder is diamide lime.

16. Method as claimed in claim 9 wherein said agent additionally contains finely divided silicon dioxide and carbon in the form of bituminous coal, hard coal, steam coal, anthracite or graphite.

* * * * *